US009719333B2

(12) United States Patent
Killough

(10) Patent No.: US 9,719,333 B2
(45) Date of Patent: Aug. 1, 2017

(54) VARIABLE FIDELITY SIMULATION OF FLOW IN POROUS MEDIA

(75) Inventor: John Edwin Killough, Austin, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 972 days.

(21) Appl. No.: 14/009,571

(22) PCT Filed: Apr. 12, 2011

(86) PCT No.: PCT/US2011/032034
§ 371 (c)(1),
(2), (4) Date: Oct. 3, 2013

(87) PCT Pub. No.: WO2012/141686
PCT Pub. Date: Oct. 18, 2012

(65) Prior Publication Data
US 2014/0032193 A1 Jan. 30, 2014

(51) Int. Cl.
*G06G 7/48* (2006.01)
*G06G 7/50* (2006.01)
*E21B 43/00* (2006.01)
*E21B 49/00* (2006.01)

(52) U.S. Cl.
CPC ..... *E21B 43/00* (2013.01); *E21B 49/00* (2013.01)

(58) Field of Classification Search
CPC ..... G06F 2217/16; E21B 43/00; E21B 49/00
USPC ..... 703/9, 10
See application file for complete search history.

(56) References Cited

U.S. PATENT DOCUMENTS

2005/0015231 A1* 1/2005 Edwards ..... E21B 49/00 703/10
2007/0027666 A1 2/2007 Frankel
2007/0265815 A1 11/2007 Couet et al.
2008/0251525 A1 10/2008 Fontaine et al.
2008/0281525 A1 11/2008 Boone
2010/0138196 A1* 6/2010 Hui ..... E21B 43/00 703/1
2010/0225647 A1 9/2010 Flew et al.
(Continued)

FOREIGN PATENT DOCUMENTS

GB 2458761 A 10/2009

OTHER PUBLICATIONS

Discovery House, Australian Government IP Australia, Notice of Acceptance, Application No. 2011365481, which is an AU counterpart to the instant application, Jul. 22, 2015.
(Continued)

*Primary Examiner* — Kamini S Shah
*Assistant Examiner* — Andre Pierre Louis
(74) *Attorney, Agent, or Firm* — Howard L. Speigt, PLLC

(57) ABSTRACT

A fine computer model covering an area includes a fine grid. A fault follows a fine-grid-path. The fault divides the area into a first fine side and a second fine. A model of a source of fluid flow is on the first fine side of the area. A model of a sink of fluid flow is on the second fine side of the area. The computer coarsens the model. The fault follows a coarse-grid-path in the coarsened model. The coarse-grid-path divides the area into a first coarse side and a second coarse side. The model of the source and the model of the sink are on the first coarse side of the area. One of the source or the sink is moved to the second coarse side of the area.

18 Claims, 3 Drawing Sheets

(56) References Cited

U.S. PATENT DOCUMENTS

| | | | | |
|---|---|---|---|---|
| 2010/0225657 | A1 | 9/2010 | Sakariya et al. | |
| 2010/0312535 | A1 | 12/2010 | Chen et al. | |
| 2013/0035913 | A1* | 2/2013 | Mishev | G06F 17/5018 703/2 |

OTHER PUBLICATIONS

Ministry of Scientific Research Academy of Scientific Research & Technology (ASRT) Patent Office, Egyptian Patent Office, Notification of an Office action and Amendments, Patent No. 2013101584, which is an EG counterpart to the instant application, May 3, 2015.

Translation of Ministry of Scientific Research Academy of Scientific Research & Technology (ASRT) Patent Office, Egyptian Patent Office, Notification of an Office action and Amendments, Patent No. 2013101584, which is an EG counterpart to the instant application, May 3, 2015.

The Eurasian Patent Office, The Eurasian Patent Organization, Application No. 201391513/(31), which is an EA counterpart to the instant application, May 29, 2015.

English translation of the Eurasian Patent Office, The Eurasian Patent Organization, Application No. 201391513/(31), which is an EA counterpart to the instant application, May 29, 2015.

International Searching Authority, International Search Report and Written Opinion of the International Searching Authority in PCT/US2011/032034, which is the PCT parent of the instant application, Jun. 7, 2011.

Canadian Intellectual Property Office, Notice of allowance, Application No. 2,830,164, which is an AU counterpart to the instant application, Feb. 24, 2016.

English translation of The State Intellectual Property Office of the People's Republic of China, Notice of the Second Office Action, Application/Patent No. 201180070050.1, which is a CN counterpart to the instant application, Mar. 23, 2016.

European Patetn Office, European Search Report, Application No./Patent No. 11863473.2-1610 / 2678803 PCT/US2011032034, which is an EP counterpart to the instant application, Apr. 4, 2016.

The State Intellectual Property Office of the People's Republic of China, Notice of the Second Office Action, Application/Patent No. 201180070050.1, which is a CN counterpart to the instant application, Mar. 23, 2016.

Kefei Wang, John E. Killough; A New Upscaling Method of Relative Permeability Curves for Reservoir Simulation; (SPE 124819); Society of Petroleum Engineers 2009.

Kefei Wang, John Killough, Kamy Sepehrnoori; SPE 124819—A New Upscaling Method for Relative Permeabilities; Halliburton 2009.

V. Gholami, S.D. Mohaghegh; Intelligent Upscaling of Static and Dynamic Reservoir Properties; (SPE 124477); Society of Petroleum Engineers 2009.

The State Intellectual Property Office of the People's Republic of China, Application/Patent No. 201180070050.1, which is a CN counterpart to the instant application, Jul. 21, 2015.

Translation of the State Intellectual Property Office of the People's Republic of China, Application/Patent No. 201180070050.1, which is a CN counterpart to the instant application, Jul. 21, 2015.

Instituto Mexicano De La Propiedad Industrial, Direccion Divisional De Patentes, Notice of acceptance, application No. MX/a/2013/011893, which is an MX counterpart to the instant application.

The State Intellectual Property Office of the People's Republic of China, Notice of Grant of Patent Right for Invention, Application/Patent No. 201180070050.1, which is a CN counterpart to the instant application, Jul. 6, 2016.

Canadian Intellectual Property Office, Examiners Requisition, Application No. 2,830,164, which is a CA counterpart of the instant application, Apr. 28, 2015.

Instituto Mexicano De La Propiedad Industrial, Communication of the result of the patent examination, Application No. MX/a/2013/011893, which is an MX counterpart to the instant application, Jan. 14, 2016.

The Eurasian Patent Organization, The Eurasian Patent Office, Notification, Application No. 201391513/(31), pp. 1-3, which is an EA counterpart to the instant application, Sep. 21, 2016, a translation filed herewith.

The English translation of the Eurasian Patent Organization, The Eurasian Patent Office, Notification, Application No. 201391513/(31), pp. 1-3, which is an EA counterpart to the instant application, Sep. 21, 2016.

Discovery House, Australian Government IP Australia, Certificate of Grant, Application No. 2011365481, which is an AU counterpart to the instant application, Nov. 19, 2015.

Discovery House, Australian Government IP Australia, Notice of Grant, Application No. 2011365481, which is an AU counterpart to the instant application, Nov. 19, 2015.

Discovery House, Australian Government IP Australia, Patent Examination Report No. 1, Application No. 2011365481, which is an AU counterpart to the instant application, Jan. 20, 2015.

* cited by examiner

VARIABLE FIDELITY SIMULATION OF FLOW IN POROUS MEDIA

CROSS REFERENCE TO RELATED APPLICATIONS

This application claims priority to International Application Serial No. PCT/US2011/032034, filed on Apr. 12, 2011, entitled Variable Fidelity Simulation of Flow in Porous Media.

BACKGROUND

Simulation of flow in porous media, such as hydrocarbon producing formations in the earth, generally involves the subdividing of the porous media into smaller portions or blocks using some form of gridding. The most popular forms for solving the equations for flow in porous media for this subdividing of the domain (gridding) are finite differences, finite volumes, and finite elements. Regardless of the form of solution, it is generally observed that finer grids (or smaller blocks) produce more accurate answers from a numerical error estimation point of view. Generally, however, finer grids require greater computing times to produce an answer. Parallel computing has helped to reduce the computing elapsed times to some extent; however, to capture as many scenarios or to better quantify uncertainties in the physical properties of the porous medium requires many simulations. Often, the models are reduced in size to reduce the time required to run each simulation. Reducing the size of the model often involves "coarsening" or "upscaling" the model. Coarsening the model while approximately maintaining the properties of the fine grid so that the coarser or "upscaled" models are able to approximately reproduce the physics in the finely gridded models, without simply interpolating the results of the fine models, is a challenge.

DETAILED DESCRIPTION

Figure 1:
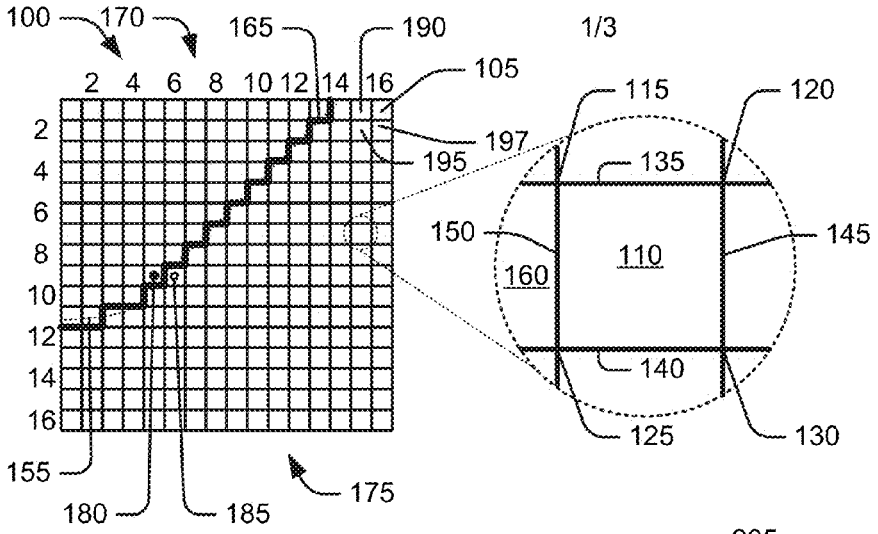
FIG. 1 is an illustration of a fine grid.

One embodiment of a technique for generating a variable fidelity model which approximately maintains the character of the model at the finest grid resolution begins with a fine model 100 of a porous media, as illustrated in FIG. 1. In one embodiment, the fine model 100 includes a grid of N fine grid cells (e.g., grid cell 105). In the example shown in FIG. 1, the grid is shown as a two dimensional grid. It will be understood that the grid can be three dimensional (i.e., "3D") or it can contain additional dimensions, such as time. In the example shown in FIG. 1, the grid is a 16×16 square of cells (or blocks), resulting in 256 blocks of uniform size. It will be understood that the grid of fine model 100 may have other shapes, such as a non-square rectangle, a polygon, a non-square rhombus, a circle, a non-circular ellipse, or other similar shapes. Further, in FIG. 1 each of the cells is shown as a square and all of the cells are the same size. It will be understood that the cells need not be square (i.e., they could be hexagonal, octagonal or another shape) and they need not be uniform in shape or size. That is, some of the cells may be larger and differently shaped than other cells.

In one embodiment, each of the N fine grid cells represents an area of the porous media. For example, assume that the fine model 100 is projected over a flat square projection of the surface of the earth. In that case each cell, i.e., grid cell 105, represents the area of the flat square projection of the surface of the earth over which that cell is projected.

In one embodiment, as illustrated in the exploded portion of FIG. 1, each of the N fine grid cells, e.g., fine grid cell 110, is defined by fine grid nodes 115, 120, 125, 130 connected by fine grid edges 135, 140, 145, 150. In one embodiment, the fine grid edges 135, 140, 145, 150 can be shared by two fine grid cells. In one embodiment, all of the edges of fine grid cell 110 are shared. For example, edge 150 is shared by fine grid cell 110 and fine grid cell 160. In one embodiment, only the two interior edges of fine grid cell 105 are shared.

In one embodiment, each of the N fine grid cells has associated with it a value of a physical property. In one embodiment, the property is porosity. In one embodiment, the property is resistivity. In one embodiment, the property is another geological property.

In one embodiment, the area modeled by the fine model 100 represents a geological area that includes a fault 155, shown on FIG. 1 by the dashed line. In one embodiment, the fault is represented in the model 100 by a fine-grid-path 165 which is along a fault-fine-grid set of edges of the N fine grid cells that are along the path of the fault. In one embodiment, the fault represents a structural discontinuity between a first fine side 170 of the area, generally to the left and above the fault 155, and a second fine side 175 of area, generally to the right and below the fault 155.

In one embodiment, the model includes a model of a source of fluid flow 180, such as a well, represented by the solid circle on FIG. 1, associated with a fine grid cell located on the first fine side of the area and a model of a sink of fluid flow 185, such as an injection well, represented by the small open circle on FIG. 1, associated with a fine grid cell located on the second fine side of the area. Thus, in the example shown in FIG. 1, the source 180 and the sink 185 are on opposite sides of the fine-grid-path 165 that represents the fault 155.

Figure 2:
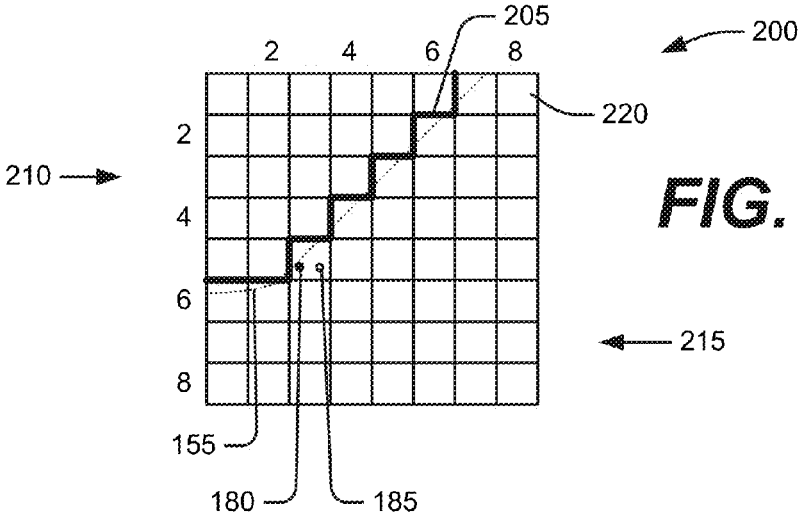
FIG. 2 is an illustration of a coarsened version of the fine grid of FIG. 1.

In one embodiment, the technique accepts the fine model 100 and coarsens it, or upscales it, to produce a coarse model of M coarse grid cells, such as the coarse model 200 shown in FIG. 2. In one embodiment, M is less than N. That is, in one embodiment, the coarse model 200 has fewer cells than the fine model 100. In one embodiment, M is much less than N. In one embodiment, M is orders of magnitude smaller than N. Just as with the fine model, the M coarse grid cells represent respective portions of the area of the porous media. In one embodiment, each of the M coarse grid cells represents a portion of the area corresponding to the portion of the area covered by A fine grid cells, A being greater than 1. For example, each coarse grid cell in FIG. 2 represents the same area as four fine grid cells in FIG. 1, so that in the example shown A=4. In one embodiment, the size of the coarse grid cells is not uniform so that the number of fine grid cells covered by each coarse grid cell is not the same. In one embodiment, the above discussion of size, shape, and other attributes of the fine grid cells applies to the coarse grid cells as well.

As with the fine model, each of the fine grid cells is defined by coarse grid nodes connected by course grid edges.

In one embodiment, the fault 155 is represented in the coarse model 200 by a coarse-grid-path 205 which is along a fault-coarse-grid set of edges of the M coarse grid cells that are along the path of the fault. In one embodiment, the coarse-grid-path 205 divides the area into a first coarse side 210 of the area, generally above and to the left of the coarse-grid-path 205, and a second coarse grid side 215 of the coarse-grid-path, generally below and to the left of the coarse-grid-path 205.

In one embodiment, the fine model 100 accounts for structural discontinuities, such as the fault 155, in some detail. In one embodiment, the importance of the fault 155 in the coarse model 200 depends on the transmissivity of the fault. For example, in one embodiment transmissive faults are modeled as a reduction in a flow coefficient across edges of adjacent cells. Similarly, in one embodiment, sealing or non-transmissive faults are modeled as having a zero flow coefficient across edges of adjacent cells.

This kind of treatment can result in error in situations such as that shown in FIG. 2, in which the source of fluid flow 180 and the sink of fluid flow 185, which were on opposite sides of a fault in the fine model 100, appear on the same side of a fault 155 in the coarse model 200. One way to avoid this problem is to retain in the coarse model 200 the fine gridding of the fine model 100 near the fault. This is the technique described in Kefei Wang and John E. Killough, "A New Upscaling Method of Relative Permeability Curves for Reservoir Simulation," (SPE 124819).

Figure 3:
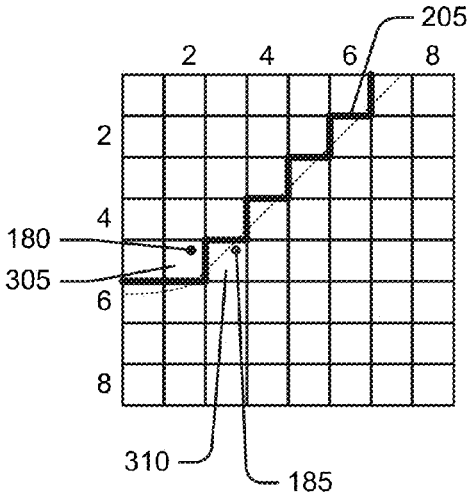
FIGS. 3 and 4 illustrate moving a sink from one side of a fault to the other side of the fault in the coarsened grid.
Figure 4:
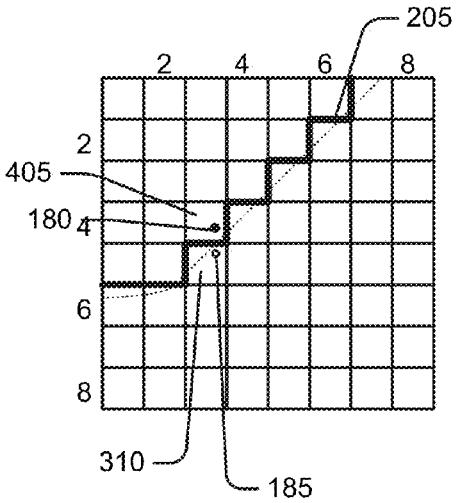

In one embodiment, the above-described error is avoided by moving one of the model of the source of fluid flow 180 or the model of the sink of the fluid flow 185 to the opposite side of the fault, as shown in FIGS. 3 and 4. In one embodiment, this action preserves the transmissivity characteristic of the fault 155 between the source 180 and the sink 185.

In one embodiment, the move of the source 180 or the sink 185 across the fault can be made to more than one candidate coarse cell. In the example shown in FIG. 3, the source 180 is moved to cell 305 while in FIG. 4, the source is moved to cell 405. Cells 305 and 405 are candidate cells.

In one embodiment, the move is made to the candidate cell which has a value of a physical property that is closest to the value of the physical property of the fine grid cell where the source 180 originally resided in the fine model 100. For example, in one embodiment, the physical property is the transmissivity across the fault. In one embodiment, a comparison is made between (a) the transmissivity of the fault 155, as represented by the fine-grid-path 165, between the fine grid cell containing the source 180 and the fine grid cell containing the sink 185 on the one hand, (b) the transmissivity of the fault 155, as represented by the coarse-grid-path 205, between cell 310 and cell 305, and (c) the transmissivity of the fault 155, as represented by the coarse-grid-path 205, between cell 310 and cell 405. In one embodiment, if (b) is a better approximation of (a) than (c) is then the move is made to cell 305. In one embodiment, if (c) is a better approximation of (a) than (b) is then the move is made to cell 405.

In one embodiment, if the comparison described above does not provide a resolution, another rule is applied. In one embodiment, the rule is to always move along the same axis. For example, in the example shown in FIGS. 2, 3, and 4, the rule may be to always move in the horizontal axis, in which case the move would be as shown in FIG. 3. Alternatively, the rule may be to always move in the vertical axis, in which case the move would be as shown in FIG. 4. In one embodiment, the direction of the move is selected randomly. In one embodiment, the direction of the move rotates among the possible move directions, i.e. horizontal, then vertical, then horizontal, etc.

In one embodiment, the rule is to select the direction for the move across the fault that is as close to perpendicular to the direction of the fault as possible. In one embodiment, the "direction of the fault" is determined based on a windowed region of the fault. In one embodiment, the window is the entire extent of the coarse model 200.

In one embodiment, the rule is to select the direction for the move across the fault that is closest to the direction between the source 180 and the sink 185 in the fine model 100. For example, using the example shown in FIGS. 1-4, the direction between the cell containing the source 180 and the cell containing the sink 185 is horizontal, which would cause the horizontal move shown in FIG. 3 to be chosen over the vertical move shown in FIG. 4.

In one embodiment, the physical properties associated with each cell of the coarse model 200 are determined. In one embodiment, the values of the physical properties associated with a coarse grid cell representing a first portion of the area are determined from the values of the physical properties of the fine grid cells representing that same area. For example, the values of the physical properties of coarse grid cell 220 (see FIG. 2) are determined from values of the physical properties of the fine grid cells 105, 190, 195, 197. In one embodiment, for the initial distribution of fluids, pressures and flow coefficients, the values of the physical properties of the coarse model 200 are determined directly from the fine model 100 using either averaging of properties or local single-phase flow modeling of each of the coarse grid cells.

In one embodiment, determining the physical properties associated with each coarse grid cell includes multi-phase flow approximations. In one embodiment, the technique described in Kefei Wang and John E. Killough, "A New Upscaling Method of Relative Permeability Curves for Reservoir Simulation," (SPE 124819) is used to modify what are known as relative permeability functions to account for the differences of flow for the coarsened grid model. In one embodiment, this technique involves matching the permeability of the fine grid cells of the fine model 100 to the permeability of the coarse grid cells of the coarse model 200 through regression. In one embodiment, this technique can be applied not only to inter-cell flow but also to the individual source terms to better match the overall fluid production behavior of the porous medium. In one embodiment, this technique has been shown to not only be able to match the fine model 100 over a simulated period but also to allow predictability of the coarse model 200 beyond the simulated period.

Figure 5:
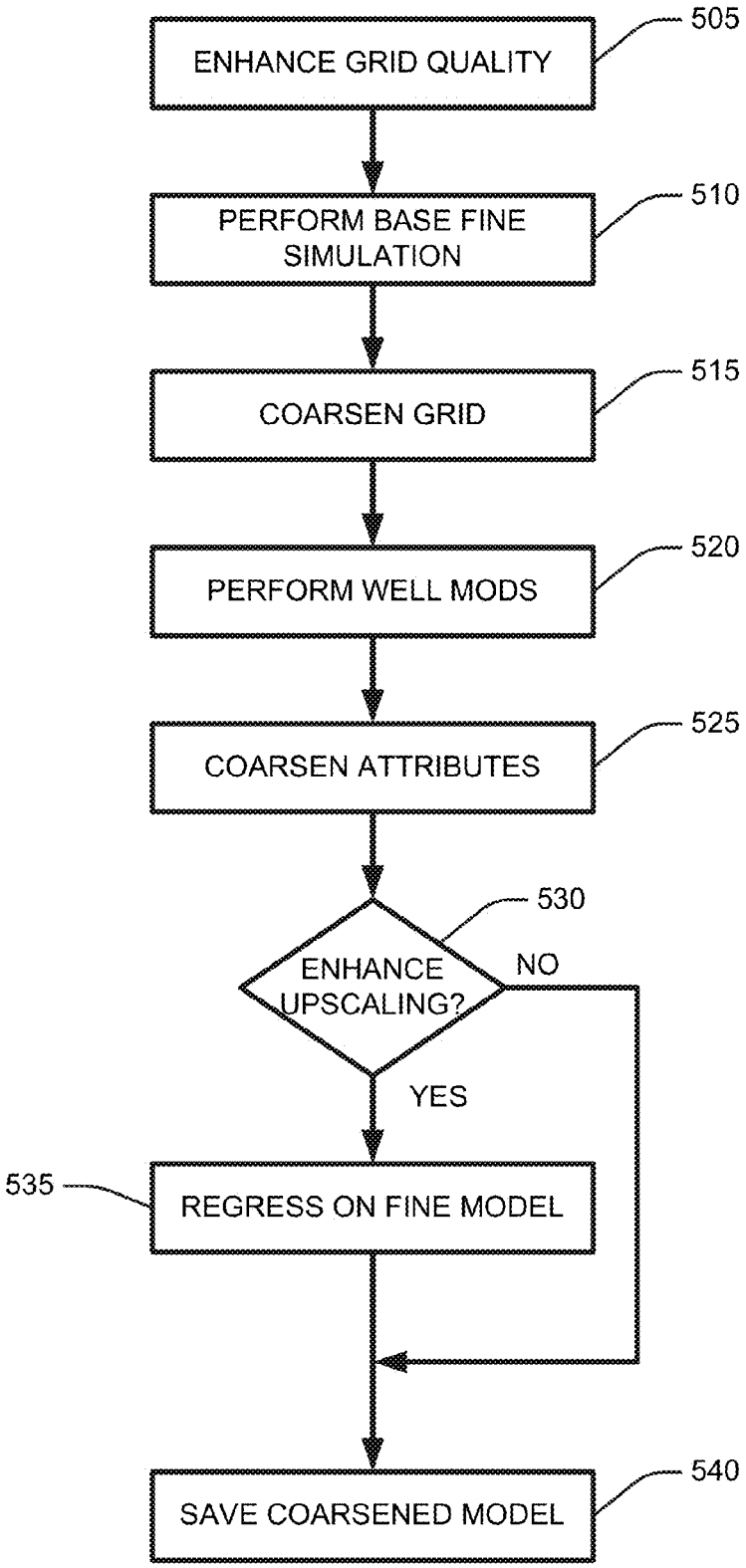
FIG. 5 is a flow chart.

In practice, as shown in FIG. 5, in one embodiment enhancing grid quality (block 505) begins by performing a base fine simulation to create the fine model 100 (block 510). In one embodiment, as each iteration of the upscaling process is performed, the fine model 100 is used as the reference. In one embodiment, the grid is then coarsened (block 505), for example to form the coarse model 200. In one embodiment, well modifications are then performed (block 520) to, for example, move a source or a sink relative to a fault to attempt to maintain the characteristics of the fine model 100 in the coarse model 200. In one embodiment, the attributes are then coarsened (block 525) through averaging, local single-phase flow modeling, or similar process as discussed above. In one embodiment, if it is desired to enhance the upscaled coarse model 200 ("yes" branch out of block 530), then a regression analysis is performed on the fine model to make multi-phase flow approximations, as described above, and the coarsened model is saved (block 540). In one embodiment, if enhancement of the coarse model to account for multi-phase flow is not desired ("no" branch out of block 530), then the coarse model 540 is saved.

In one embodiment, the model can be further coarsened by repeating blocks 515 through 540.

Figure 6:
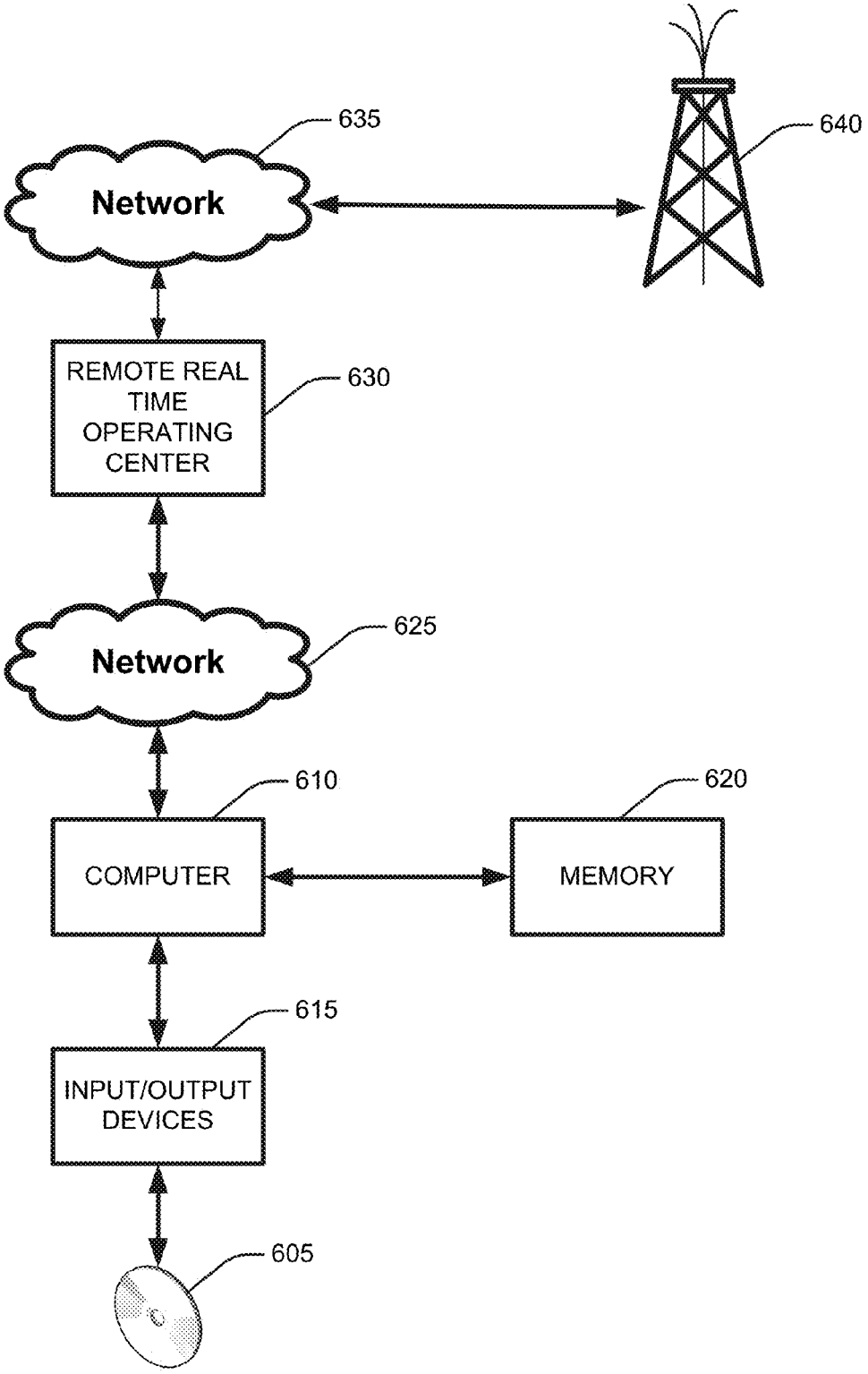
FIG. 6 is a block diagram of a system.

In one embodiment, the software to perform the functions illustrated in FIG. 5 is stored in the form of a computer program on a computer readable media 605, such as a CD or DVD, as shown in FIG. 6. In one embodiment a computer 610 reads the computer program from the computer readable media 605 through an input/output device 615 and stores it in a memory 620 where it is prepared for execution through compiling and linking, if necessary, and then executed. In one embodiment, the system accepts inputs through an input/output device 615, such as a keyboard, and provides outputs through an input/output device 615, such as a monitor or printer. In one embodiment, the system stores the results of calculations in memory 620 or modifies such calculations that already exist in memory 620.

In one embodiment, the results of calculations that reside in memory 620 are made available through a network 625 to a remote real time operating center 630. In one embodiment, the remote real time operating center 630 makes the results of calculations available through a network 635 to help in the planning of oil wells 640 or in the drilling of oil wells 640.

For example, in one embodiment the coarse model 200 is used to determine that a drilling rig should divert a drill string into an area that the model predicts will have high permeability and therefore is more likely to contain valuable hydrocarbons. The ability to move sources and sinks relative to a fault in order to maintain the accuracy of the coarse model improves the likelihood that the drilling rig will drill into an underground region that contains such valuable hydrocarbons.

The text above describes one or more specific embodiments of a broader invention. The invention also is carried out in a variety of alternate embodiments and thus is not limited to those described here. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method comprising:

(a) a computer accepting a fine model of a porous media covering an area, the model comprising:

a grid of N fine grid cells, each of the N fine grid cells representing a portion of the area, each of the fine grid cells defined by fine grid nodes connected by fine grid edges;

a physical property having a value for each of the N fine grid cells;

a fault following a fine-grid-path along a fault-fine-grid set of edges of the N fine grid cells, the fault representing a structural discontinuity between a first fine side of the area and a second fine side of area; a model of a source of fluid flow associated with a fine grid cell located on the first fine side of the area; and a model of a sink of fluid flow associated with a fine grid cell located on the second fine side of the area;

(b) the computer coarsening the model by: creating a grid of M coarse grid cells, M<N, such that each of the M coarse grid cells represents a portion of the area corresponding to A fine grid cells, A>1, each of the coarse grid cells defined by coarse grid nodes connected by coarse grid edges;

a fault following a coarse-grid-path along a fault-course-grid-set of coarse grid edges of the M course cells, the coarse-grid-path dividing the area into a first coarse side of the area and a second coarse side of the area;

the fine grid cell associated with the source of fluid flow and the fine grid cell associated with the sink of fluid flow corresponding to coarse grid cells on the first coarse side of the area;

(c) the computer moving one of the model of the source of fluid flow or the model of the sink of the fluid flow from an origination-coarse-grid-cell on the first coarse side of the are to a destination-coarse-grid-cell on the second coarse side of the area, wherein the moving comprises: determining that there are two candidate coarse grid cells on the second coarse side of the area that share an edge with the origination-coarse-grid-cell, determining that a physical value of the two candidate coarse grid cells is the same, and applying a rule to select the destination-coarse-grid-cell from between the two candidate coarse grid cells;

(d) the computer using the coarsened model to create a plan to drill a well; and (e) drilling the well using the plan.

2. The method of claim 1 further comprising:

(f) determining a value of the physical property associated with a coarse grid cell representing a first portion of the area from the values of the physical property of the fine grid cells representing the first portion of the area.

3. The method of claim 1 further comprising:

(f) determining a value of the physical property associated with a coarse grid cell representing a first portion of the area by averaging the values of the physical property of the fine grid cells representing the first portion of the area.

4. The method of claim 1 further comprising:

(f) determining a value of the physical property associated with a coarse grid cell representing a first portion of the area by local single-phase flow modeling of the coarse grid cell representing the first portion of the area.

5. The method of claim 1 further comprising:

(f) determining a value of the physical property associated with a coarse grid cell representing a first portion of the area by multi-phase flow modeling of the coarse grid cell representing the first portion of the area.

6. The method of claim 1 wherein:

the origination-coarse-grid-cell shares an edge with the destination-coarse-grid-cell.

7. The method of claim 1 wherein (c) moving one of the model of the source of fluid flow or the model of the sink of the fluid flow from an origination-coarse-grid-cell to a destination-coarse-grid-cell on the second coarse side of the area comprises:

determining that there are two candidate coarse grid cells on the second coarse side of the area that share an edge with the origination-coarse-grid-cell; and the destination-coarse-grid-cell being selected from the one of the two candidate coarse grid cells whose physical property value is closest to the physical property value of the fine grid cell that contained the one of the model of the source of fluid flow or the model of the sink of the fluid flow.

8. The method of claim 1 wherein the grid of M coarse grid cells includes an axis and the rule comprises selecting as the destination-coarse-grid-cell the candidate coarse grid cell along the axis from the origination-coarse-grid cell.

9. The method of claim 1 wherein the rule comprises selecting as the destination-coarse-grid-cell the candidate coarse grid cell that is at a direction from the origination-coarse-grid-cell that is closest to perpendicular to the coarse-grid-path.

10. A computer program stored in a non-transitory tangible computer readable storage medium, the program comprising executable instructions that cause a computer to:

(a) accept a fine model of a porous media covering an area, the model comprising:

a grid of N fine grid cells, each of the N fine grid cells representing a portion of the area, each of the fine grid cells defined by fine grid nodes connected by fine grid edges;

a physical property having a value for each of the N fine grid cells; a fault following a fine-grid-path along a fault-fine-grid set of edges of the N fine grid cells, the fault representing a structural discontinuity between a first fine side of the area and a second fine side of area;

a model of a source of fluid flow associated with a fine grid cell located on the first fine side of the area; and a model of a sink of fluid flow associated with a fine grid cell located on the second fine side of the area;

(b) coarsen the model by: creating a grid of M coarse grid cells, M<N, such that each of the M coarse grid cells represents a portion of the area corresponding to A fine grid cells, A>1, each of the coarse grid cells defined by coarse grid nodes connected by coarse grid edges;

a fault following a coarse-grid-path along a fault-course-grid-set of coarse grid edges of the M course cells, the coarse-grid-path dividing the area into a first coarse side of the area and a second coarse side of the area;

the fine grid cell associated with the source of fluid flow and the fine grid cell associated with the sink of fluid flow corresponding to coarse grid cells on the first coarse side of the area;

(c) move one of the model of the source of fluid flow or the model of the sink of the fluid flow from an origination-coarse-grid-cell on the first coarse side of the are to a destination-coarse-grid-cell on the second coarse side of the area, wherein the moving comprises: determining that there are two candidate coarse grid cells on the second coarse side of the area that share an edge with the origination-coarse-grid-cell, determining that a physical value of the two candidate coarse grid cells is the same, and applying one or more rule to select the destination-coarse-grid-cell from between the two candidate coarse grid cells;

(d) use the coarsened model to create a plan to drill a well; and (e) drill the well using the plan.

11. The computer program of claim 10 further comprising executable instructions that cause the computer to:

(f) determine a value of the physical property associated with a coarse grid cell representing a first portion of the area from the values of the physical property of the fine grid cells representing the first portion of the area.

12. The computer program of claim 10 further comprising executable instructions that cause the computer to:

(f) determine a value of the physical property associated with a coarse grid cell representing a first portion of the area by averaging the values of the physical property of the fine grid cells representing the first portion of the area.

13. The computer program of claim 10 further comprising executable instructions that cause the computer to:

(f) determine a value of the physical property associated with a coarse grid cell representing a first portion of the area by local single-phase flow modeling of the coarse grid cell representing the first portion of the area.

14. The computer program of claim 10 further comprising executable instructions that cause the computer to:

(f) determine a value of the physical property associated with a coarse grid cell representing a first portion of the area by multi-phase flow modeling of the coarse grid cell representing the first portion of the area.

15. The computer program of claim 10 wherein:

the origination-coarse-grid-cell shares an edge with the destination-coarse-grid-cell.

16. The computer program of claim 10 wherein when (c) moving one of the model of the source of fluid flow or the model of the sink of the fluid flow from an origination-coarse-grid-cell to a destination-coarse-grid-cell on the second coarse side of the area, the computer:

determines that there are two candidate coarse grid cells on the second coarse side of the area that share an edge with the origination-coarse-grid-cell; and selects the destination-coarse-grid-cell from the one of the two candidate coarse grid cells whose physical property value is closest to the physical property value of the fine grid cell that contained the one of the model of the source of fluid flow or the model of the sink of the fluid flow.

17. The computer program of claim 10 wherein the grid of M coarse grid cells includes an axis and the rule comprises selecting as the destination-coarse-grid-cell the candidate coarse grid cell along the axis from the origination-coarse-grid cell.

18. The computer program of claim 10 wherein the rule comprises selecting as the destination-coarse-grid-cell the candidate coarse grid cell that is at a direction from the origination-coarse-grid-cell that is closest to perpendicular to the coarse-grid-path.

* * * * *